US006125594A

United States Patent [19]

Hudson

[11] Patent Number: 6,125,594

[45] Date of Patent: Oct. 3, 2000

[54] ROOF ANGLE ATTACHMENT DEVICE

[76] Inventor: Mark Hudson, 15587 Aspen, Macomb, Mich. 48044

[21] Appl. No.: 09/280,943

[22] Filed: Mar. 29, 1999

[51] Int. Cl.[7] ..... E04H 1/00

[52] U.S. Cl. ..... 52/92.2; 52/713; 52/98; 52/238.1; 52/241

[58] Field of Search ..... 52/92.2, 713, 98, 52/243.1, 238.1, 241; 403/403, 231, 306; 248/354.5, 346.5

[56] References Cited

U.S. PATENT DOCUMENTS 4,381,635 5/1983 Solo .
4,449,335 5/1984 Fahey .
4,594,823 6/1986 Hague .
4,631,878 12/1986 Laramore .
5,040,345 8/1991 Gilmour .
5,657,596 8/1997 Powers, III ..... 52/262
5,720,571 2/1998 Frobosilo et al. ..... 403/403
5,846,018 12/1998 Frobosilo et al. ..... 403/403
5,941,029 8/1999 MacLeod ..... 52/167.1

*Primary Examiner*—Christopher T. Kent
*Assistant Examiner*—Jennifer I. Thissell

[57] ABSTRACT

A roof angle attachment device (10) attachable to a vertical stud (14). The roof angle attachment device (10) having a left mount (12L) which has a left mount clip (12LA) positioned along a top distal edge functioning to hold a roof angle (16) to support exterior framing (18). The roof angle attachment device (10) further has a right mount (12R) securely attached along a left distal edge to a right distal edge of the left mount (12L). The right mount (12R) further comprises at least one right mount opening (12RA) wherein a fastener is positioned therethrough to securely attach the right mount (12R) to the vertical stud (14).

2 Claims, 2 Drawing Sheets

Detail B

Detail B

ROOF ANGLE ATTACHMENT DEVICE

BACKGROUND OF THE INVENTION

1. Field of the Invention

The present invention relates to building construction. More particularly, the present invention relates to framing using metal frames.

2. Description of the Prior Art

Metal framing requires specialized construction methods which are significantly than those used in wood construction. In particular the metal vertical members must be fastened to the sides of the floor beams. The present methods use expensive screws which can withstand the sheer loads of the floor beams pushing downward. An alternaticve is a shot and pins which is time consuming to position. What is needed is a simple device that reduces the construction time and eliminates the need for expensive fastenings.

Numerous innovations for roof angle attachment device have been provided in the prior art that are described as follows. Even though these innovations may be suitable for the specific individual purposes to which they address, they differ from the present invention as hereinafter contrasted.

In U.S. Pat. No. 5,040,345, titled Stud Clip for Allowing Vertical Floating Movement of a Floor or Roof Structure, invented by Michael F. Gilmour, a stud clip is described for allowing vertical floating movement of a horizontal structure such as a roof element or floor element mounted thereon vertically slidingly associated with a fixed C shaped vertical non-load bearing building stud, said clip being generally U shaped and having a perimeter conforming to the interior cross section of said stud and engaging said interior including opposed recesses to receive inturned lips of said stud and affixed to said horizontal structure.

The patented invention differs from the present invention because the patented invention is a stud clip is described which permits vertical floating movement of a horizontal structure such as a roof element. The stud clip is generally U shaped and has a perimeter conforming to the interior cross section of said stud and engaging said interior including opposed recesses to receive inturned lips of said stud and affixed to said horizontal structure. The present invention is an 'L' shaped bracket which supports a vertical stud. The 'L' shaped bracket has a clip attached to the top of one side. The clip is adapted to securely attach to a roof angle. A plurality of predrilled holes are positioned in the opposite side of the 'L' shaped bracket. The predrilled holes are positioned so that when fasteners are inserted through the holes a stud is securely attached to the 'L' shaped bracket.

In U.S. Pat. No. 4,631,878, titled Pedestal and Framing System for Supplemental Roof Construction, invented by Larry W. Laramore, a pedestal is described for use in conjunction with a framing member to support a supplemental roof in superposed spaced relation to a deck roof or other primary roof of a building. Since blanket or other conventional insulation can be placed in the spaces between the primary and supplemental roofs and between adjacent pedestals, the aesthetics of the exposed plank ceiling are preserved. To transfer vertical loading, each of the pedestals is positioned to overlie, and be anchored to, a framing member of the primary roof. At the peak of the roof, complementary configured tabs and receptacles interconnect the adjacent pedestals. Use of wider framing members or an optional extension cap and spacer block increases the spacing between the primary and supplemental roofs to accommodate additional insulation. To avoid condensation and conductive heat losses, the pedestal, extension cap, and spacer block are each preferably single pieces of plastic, with the pedestal and spacer block having honeycomb cores that are filled with an insulating material.

The patented invention differs from the present invention because the patented invention is a pedestal for use in conjunction with a framing member to support a supplemental roof in superposed spaced relation to a deck roof or other primary roof of a building. To transfer vertical loading, each of the pedestals is positioned to overlie, and be anchored to, a framing member of the primary roof The patented invention lacks features similar to the present invention.

In U.S. Pat. No. 4,594,823, titled Panel Support Assembly for Concealed Fastener Roof Structure, invented by James G. Hague, a panel support assembly is described for use in concealed fastener roof systems. An array of rows and columns of support assemblies can be erected in a manner which facilitates "moduling" of the panel members to conform the panel coverage to that required by the steel framing. In each row, means is provided for incrementally increasing or decreasing a selected modular distance between fixed clip means of adjacent support assemblies thereby to accommodate differences between the "as engineered" dimensions and the "as built" dimensions of the steel framing. An improved roof structure is disclosed utilizing rows of fixing, clipping, and sliding support assemblies arranged to allow problem-free thermal expansion and contraction of overlapping courses of the panel members.

The patented invention differs from the present invention because the patented invention is an array of rows and columns of support assemblies can be erected in a manner which facilitates "moduling" of the panel members to conform the panel coverage to that required by the steel framing. An improved roof structure is disclosed utilizing rows of fixing, clipping, and sliding support assemblies arranged to allow problem-free thermal expansion and contraction of overlapping courses of the panel members. The patented invention lacks a support means for vertical studs. The patented invention lacks features similar to the present invention.

In U.S. Pat. No. 4,449,335, titled Roof Framing System, invented by Patrick Fahey, a roof framing system is described which has an apex bracket and two bracket assemblies, each bracket assembly consisting of a rafter bracket and sill plate bracket. The apex bracket has two U-shaped sections joined by a bendable intermediate section. The U-shaped sections grasp the upper end of a pair of opposing rafters, while the bendable section accommodates the desired pitch of the roof. The rafter bracket has a U-shaped section for grasping the lower end of a rafter bracket and has two arms separated by a distance sufficient to allow a rafter to be disposed therebetween. The sill plate bracket has a right-angled section for mounting a top sill plate and has two arms separated by a distance sufficient to allow a rafter to be disposed therebetween. The sill plate bracket's arms receive and support the rafter bracket's arms, thereby allowing opposing rafters to be mounted at their lower end and subsequently to be rotated towards the apex of the roof for joining by the apex bracket.

The patented invention differs from the present invention because the patented invention is a roof framing system consisting of an apex bracket and two bracket assemblies, each bracket assembly consisting of a rafter bracket and sill plate bracket. The patented invention functions to attach a roof beam to a header. The patented invention is not adapted to attach to metal vertical studs.

In U.S. Pat. No. 4,381,635, titled Instant Truss Roof Support System, invented by Charles P. Solo, an add-on roof reinforcing brace is described for buttressing the structural strength of roof rafters which have been weakened by age and deterioration. The add-on brace of the present invention provides a quick and economical means of vertically orientating a square-cut stud, between an angled roof rafter and a horizontally disposed ceiling joist. To this end, a joist attachment member secures one distal end of the stud to the ceiling joist and a rafter attachment member secures the other distal end of the stud to the roof rafter. The rafter attachment member includes a sleeve for attaching said rafter attachment member to the other end of the stud, a saddle-shaped member for attaching said rafter attachment member to a roof rafter, and a pivot member for pivotably interconnecting the sleeve and the saddle-shaped member. The sleeve member may be selectively angulated relative to the saddle-shaped member to dispose the stud in a generally vertical attitude regardless of the geometric angle between the roof rafter and the ceiling joist.

The patented invention differs from the present invention because the patented invention is an add-on roof reinforcing brace is described for buttressing the structural strength of roof rafters which have been weakened by age and deterioration. The patented invention lacks features similar to the present invention.

Numerous innovations for roof angle attachment device have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is an 'L' shaped bracket which supports a vertical stud used in metal framing construction. The present invention is a fast, inexpensive method of attaching metal vertical members or studs to the sides of the floorbeams and roof beams. The present invention uses inexpensive screws to attach the 'L' shaped bracket and withstand the sheer loads of the floor beams pushing downward. The 'L' shaped bracket has a clip attached to the top of one side. The clip is adapted to securely attach to a roof angle. A plurality of predrilled holes are positioned in the opposite side of the 'L' shaped bracket. The predrilled holes are positioned so that when fasteners are inserted through the holes a stud is securely attached to the 'L' shaped bracket.

The types of problems encountered in the prior art are attachment of studs to floor and roof beams in metal construction.

In the prior art, unsucessful attempts to solve this problem were attempted namely shot pins and 'TEK'® screws. However, the problem was solved by the present invention because the namely shot pins are not needed and inexpensive screws are used.

Innovations within the prior art are rapidly being exploited as metal construction increases.

The present invention went contrary to the teaching of the art because a inexpensive clip is used to replace shot pins and high tensile screws.

The present invention solved a long felt need for a inexpensive attachment means.

Accordingly, it is an object of the present invention to provide an interface between a existing roof or floor joist and a vertical metal stud.

More particularly, it is an object of the present invention to provide a mechanical attachment using common fastenings to reduce costs In keeping with these objects, and with others which will become apparent hereinafter, one feature of the present invention resides, briefly stated, in a roof angle attachment device which is 'L' shaped and provides a mechanical inteface between the roof beam and the stud in metal construction.

When the roof angle attachment device is designed in accordance with the present invention, a a clip is provided which is positioned over the upper edge of a roof angle.

In accordance with another feature of the present invention, left mount having a left mount clip.

Another feature of the present invention is that the left mount clip has a left mount clip hinge, left mount clip holder (12LAB), and a left mount clip lip.

Yet another feature of the present invention is that a right mount has at least one right mount opening functioning to permit the insertion of common fastenings therethrough to attach the roof angle attachment device to a stud.

Still another feature of the present invention is that the left mount clip may be moved along the roof angle to a preselected position in conforamce with building codes.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—roof angle attachment device (10)
12L—left mount (12L)
12LA—left mount clip (12LA)
12LAA—left mount clip hinge (12LAA)
12LAB—left mount clip holder (12LAB)
12LAC—left mount clip lip (12LAC)
12R—right mount (12R)
12RA—right mount opening (12RA)
14—vertical stud (14)
16—roof angle (16)
18—exterior framing (18)

DESCRIPTION OF THE PREFERRED EMBODIMENT

Figure 1:
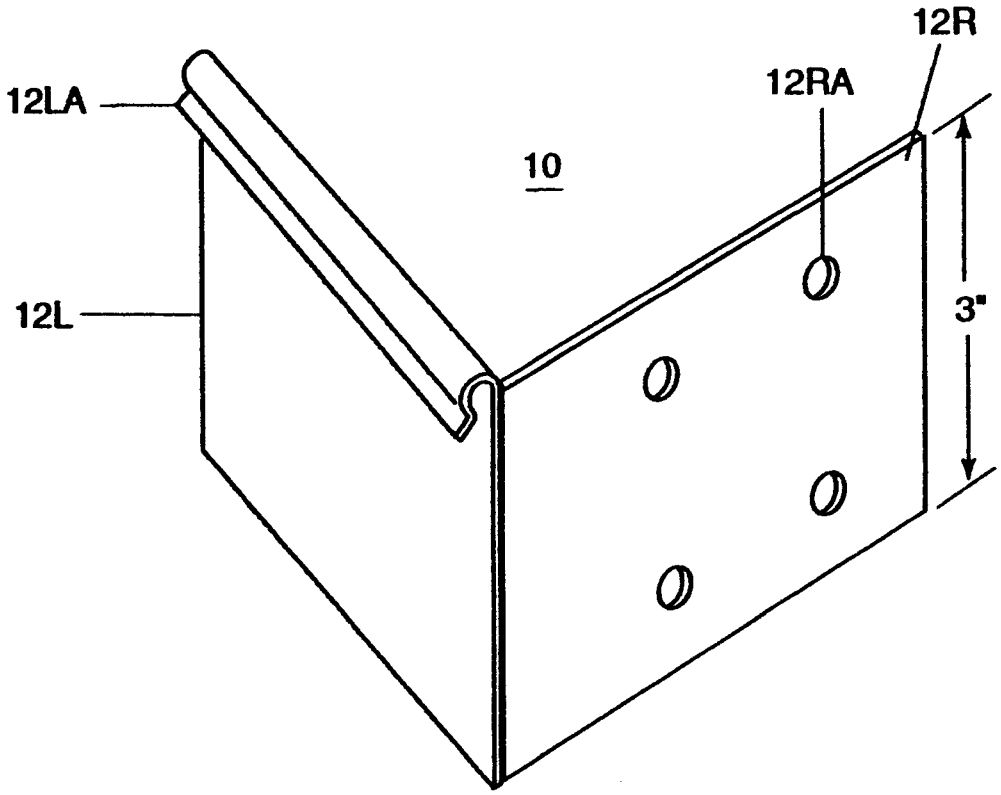
FIG. 1 is a top perspective view of a roof angle attachment device.

First, referring to FIG. 1 which is a top perspective view of a roof angle attachment device (10). The roof angle attachment device (10) attachable to a vertical stud (14). The roof angle attachment device (10) comprises a left mount (12L).

The roof angle attachment device (10) further comprises a right mount (12R) securely attached along a left distal edge to a right distal edge of the left mount (12L). The right mount (12R) further comprises at least one right mount opening (12RA) wherein a fastener is positioned therethrough to securely attach the right mount (12R) to the vertical stud (14).

The roof angle attachment device (10) is constructed from a material selected from a group consisting of metal, metal alloy, plastic, and plastic composite.

Figure 2:
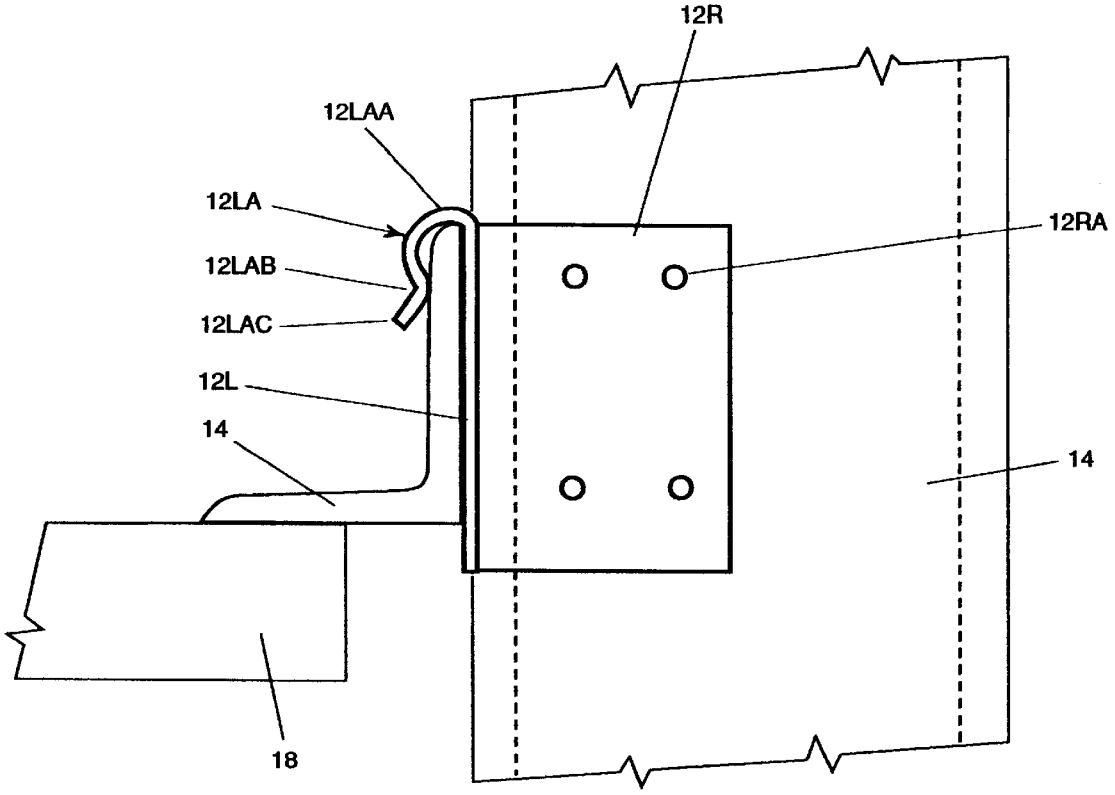
FIG. 2 is a left side view of a roof angle attachment device attached to a vertical stud holding a roof angle supporting exterior framing.

Lastly, referring to FIG. 2 which is a left side view of a roof angle attachment device (10) attached to a vertical stud (14) holding a roof angle (16) supporting exterior framing (18). The roof angle attachment device (10) attachable to a vertical stud (14). The roof angle attachment device (10) comprises a left mount (12L) which comprises a left mount clip (12LA) positioned along a top distal edge functioning to hold a roof angle (16) to support exterior framing (18).

The left mount clip (12LA) further comprises a left mount clip hinge (12LAA). The left mount clip (12LA) further comprises a left mount clip holder (12LAB) portioned along a edge below the left mount clip hinge (12LAA). The left mount clip (12LA) further comprises a left mount clip lip (12LAC) portioned along a edge below the left mount clip holder (12LAB). The left mount clip lip (12LAC) functions to facilitate insertion of the roof angle (16) into the left mount clip (12LA). The left mount clip hinge (12LAA) is manufactured from a resilient material biasing the left mount clip holder (12LAB) into frictional engagement with the roof angle (16). Because the left mount clip (12LA) movably attached to the roof angle (16) it may be moved along the roof angle (16) to a preselected position.

The roof angle attachment device (10) further comprises a right mount (12R) securely attached along a left distal edge to a right distal edge of the left mount (12L). The right mount (12R) further comprises at least one right mount opening (12RA) wherein a fastener is positioned therethrough to securely attach the right mount (12R) to the vertical stud (14).

The roof angle attachment device (10) is constructed from a material selected from a group consisting of metal, metal alloy, plastic, and plastic composite.

It will be understood that each of the elements described above, or two or more together, may also find a useful application in other types of constructions differing from the type described above.

While the invention has been illustrated and described as embodied in a roof angle attachment device, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A roof angle attachment device (10) attachable to a vertical stud (14), the roof angle attachment device (10) comprising:

A) a left mount (12L) which comprises a left mount clip (12LA) positioned along a top distal edge extending downwardly in a range between 10% and 20% of a height of the left mount (12L), the left mount clip (12L) functioning to hold a roof angle (16) to support exterior framing (18), the left mount clip (12LA) further comprises a left mount clip hinge (12LAA), the left mount clip (12LA) further comprises a left mount clip holder (12LAB) portioned along a edge below the left mount clip hinge (12LAA), the left mount clip (12LA) further comprises a left mount clip lip (12LAC) portioned along a edge below the left mount clip holder (12LAB), the left mount clip lip (12LAC)functions to facilitate insertion of the roof angle (16) into the left mount clip (12LA); and B) a right mount (12R) securely attached along a left distal edge to a right distal edge of the left mount (12L), the right mount (12R) further comprises at least one right mount opening (12RA) wherein a fastener is positioned therethrough to securely attach the right mount (12R) to the vertical stud (14).

2. The roof angle attachment device (10) as described in claim 1 is constructed from a material selected from a group consisting of metal, metal alloy, plastic, and plastic composite.

* * * * *